US011746640B2

(12) United States Patent
Tang et al.

(10) Patent No.: US 11,746,640 B2
(45) Date of Patent: Sep. 5, 2023

(54) SOLID FLUIDIZATION TUBULAR SEPARATOR FOR MARINE NATURAL GAS HYDRATE

(71) Applicants: Southern Marine Science and Engineering Guangdong Laboratory (Zhanjiang), Zhanjiang (CN); Southwest Petroleum University, Chengdu (CN)

(72) Inventors: Yang Tang, Chengdu (CN); Zeliang Li, Chengdu (CN); Xushen Li, Zhanjiang (CN); Jiang Lu, Chengdu (CN); Xiaoyu Fang, Zhanjiang (CN); Guorong Wang, Chengdu (CN); Pu Yang, Zhanjiang (CN); Jinhai Zhao, Chengdu (CN); Xiaolong Ma, Zhanjiang (CN); Dongqing Xia, Zhanjiang (CN); Lin Zhong, Chengdu (CN); Yufa He, Zhanjiang (CN); Qingping Li, Zhanjiang (CN); Yanjun Li, Chengdu (CN); Hexing Liu, Chengdu (CN); Peng Zhao, Chengdu (CN)

(73) Assignees: Southern Marine Science and Engineering Guangdong, Zhanjiang (CN); Southwest Petroleum University, Chengdu (CN)

( * ) Notice: Subject to any disclaimer, the term of this patent is extended or adjusted under 35 U.S.C. 154(b) by 5 days.

(21) Appl. No.: 17/676,250

(22) Filed: Feb. 21, 2022

(65) Prior Publication Data

US 2022/0349292 A1 Nov. 3, 2022

(51) Int. Cl.

| | |
|---|---|
| ***E21B 43/34*** | (2006.01) |
| ***E21B 43/36*** | (2006.01) |
| ***E21B 43/01*** | (2006.01) |

(52) U.S. Cl.

CPC ..... *E21B 43/36* (2013.01); *E21B 43/01* (2013.01); *E21B 43/35* (2020.05)

(58) Field of Classification Search

CPC ..... E21B 43/35; E21B 43/36

See application file for complete search history.

(56) References Cited

U.S. PATENT DOCUMENTS 5,662,167 A * 9/1997 Patterson ..... B01D 21/0003 166/105.1
9,045,979 B2 * 6/2015 Cobb ..... E21B 43/127
(Continued)

FOREIGN PATENT DOCUMENTS

CN 1268068 A * 9/2000 ..... B01D 19/0026
GB 2409691 A * 7/2005 ..... E21B 43/38

*Primary Examiner* — Matthew R Buck

(57) ABSTRACT

The disclosure discloses a solid fluidization tubular separator for marine natural gas hydrate, which includes a first separator and a second separator, wherein the first separator includes the first separation sleeve, the power liquid pipe, the swirl baffle, the recovery mechanism and the sand discharge mechanism. After the hydrate is sucked into the first separation sleeve to generate a circumferential velocity, so that the mud and sand with high density are separated to the pipe wall of the first separation sleeve, and the mud and sand separated to the pipe wall are settled down from the gap between the swirl baffle and the pipe wall along the pipe wall. The hydrate swirl flows into the recovery mechanism, and then leaves the first separation sleeve and enters the second separator, so as to realize the separation of mud and sand and natural gas hydrate.

10 Claims, 9 Drawing Sheets

(56) References Cited

U.S. PATENT DOCUMENTS

| | | | | |
|---|---|---|---|---|
| 10,760,398 | B2 * | 9/2020 | Webber | B01D 45/16 |
| 2003/0196952 | A1 * | 10/2003 | Kampfen | B01D 21/267<br>210/512.3 |

* cited by examiner

SOLID FLUIDIZATION TUBULAR SEPARATOR FOR MARINE NATURAL GAS HYDRATE

CROSS REFERENCE TO RELATED APPLICATION

This application claims priority to Chinese Application No. 202110466757.X, filed on Apr. 28, 2021, entitled "SOLID FLUIDIZATION TUBULAR SEPARATOR FOR MARINE NATURAL GAS HYDRATE", and No. 202110466757.X, filed on Mar. 3, 2021, entitled "Solid fluidized tube type separator for marine gas hydrates". These contents are hereby incorporated by reference.

TECHNICAL FIELD

The disclosure relates to the technical field of natural gas hydrate separation, in particular to a solid fluidization tubular separator for marine natural gas hydrate.

BACKGROUND

The natural gas hydrate (hereinafter referred to as hydrate) existing on the seabed has an ambient temperature above 0° C. and no ice in the pores. The hydrate is located in large water depth and shallow buried depth with weak or no consolidation of the skeleton, causing complex engineering geological conditions.

The existing seabed natural gas hydrate separation method is single and the sand removal effect is poor. However, the diameter of mud and sand particle in hydrate formation often reaches micron scale, and the existing sand removal and separation device cannot meet the requirements at all.

SUMMARY

A The disclosure aims to solve at least one of the technical problems existing in the prior technology. Therefore, the disclosure provides a solid fluidization tubular separator for marine natural gas hydrate to improve the sand removal effect.

A solid fluidization tubular separator for marine natural gas hydrate provided by the present disclosure includes a first separator, wherein the first separator includes a first separation sleeve, a power liquid pipe, a swirl baffle, a recovery mechanism and a sand discharge mechanism; the first separation sleeve is provided with a first suction inlet, the first suction inlet is arranged at a middle and upper part of the first separation sleeve, and the first suction inlet is a helical shape; the power liquid pipe is arranged in the first separation sleeve, and an axis of the power liquid pipe coincides with an axis of the first separation sleeve; the swirl baffle is arranged on an outer circumference of the power liquid pipe, and there is a gap between the swirl baffle and an inner wall of the first separation sleeve; the recovery mechanism is arranged above the swirl baffle, the recovery mechanism includes a recovery sleeve, the recovery sleeve is arranged on the power liquid pipe; a inner diameter of the recovery sleeve is greater than an outer diameter of the power liquid pipe, and an upper part of the recovery sleeve is connected with the first separation sleeve; the gap between the recovery sleeve and the power liquid pipe forms a hydrate recovery channel; the sand discharge mechanism is connected to a lower end of the first separation sleeve: a second separator is further provided, wherein the second separator is connected to an upper end of the first separation sleeve, and the hydrate enters the second separator through the recovery mechanism.

Preferably, the power liquid pipe includes a first power liquid pipe, a second power liquid pipe and a third power liquid pipe, the first power liquid pipe and the third power liquid pipe are fixedly arranged, and the second power liquid pipe is rotationally connected with the first power liquid pipe and the third power liquid pipe respectively; the recovery sleeve is integrally arranged with the second power liquid pipe, the recovery sleeve is rotationally connected to the first separation sleeve, an interior of the second power liquid pipe is fixedly provided with a first helical blade, an outer pipe wall of the recovery sleeve is provided with a crushing reamer, and the first helical blade is driven by dynamic liquid to drive the second power liquid pipe to rotate, so as to drive the recovery sleeve to rotate.

Preferably, an outer wall of the second power liquid pipe is provided with a second helical blade, and a rotation direction of the second helical blade is opposite to the first helical blade.

Preferably, a lower end of the recovery sleeve is located between the first suction inlet and the swirl baffle.

Preferably, the sand discharge mechanism includes a sliding sleeve and a spring, the sliding sleeve is sleeved on the power liquid pipe, the spring is fixedly connected to the lower end of the sliding sleeve; the sand discharge mechanism is provided with a first sand discharge hole, and the sliding sleeve is moved downward by compressing the spring to communicate the first sand discharge hole with the first separation sleeve.

Preferably, the first separator further includes a flow stabilization baffle, and the flow stabilization baffle is arranged between the swirl baffle and the sand discharge mechanism.

Preferably, the first separator further includes a balance device, the balance device includes a balance valve, and the balance valve is arranged between the flow stabilization baffle and the sand discharge mechanism.

Preferably, the second separator includes a first sleeve, a second sleeve and a second separation sleeve, the first sleeve is sleeved on the power liquid pipe, and the second sleeve is arranged between the power liquid pipe and the first sleeve; an upper end of the second sleeve is fixedly connected to the second separation sleeve, an lower end of the second separation sleeve is butted with the upper end of the first separation sleeve, an upper part of the first sleeve is provided with a second suction inlet, the second separator is provided with a second sand discharge hole, and the second sand discharge hole is arranged on the first sleeve.

Preferably, the upper end of the first sleeve is a helical sleeve, and the second suction inlet is arranged on the helical sleeve.

Preferably, a lower part of the first sleeve is conical.

The solid fluidization tubular separator for marine natural gas hydrate according to the embodiment of the disclosure has at least the following advantageous effects: Since the first suction inlet is helical, the hydrate is sucked into the first separation sleeve to produce circumferential velocity, and the mud and sand with high density are separated on the pipe wall of the first separation sleeve. The mud and sand separated to the pipe wall will settle down from the gap between the swirl baffle and the pipe wall along the pipe wall, and finally accumulate on the sand discharge mechanism. Because the density of hydrate is small, it converges in the middle of the first separation sleeve and continues to flow downward to the swirl baffle. The hydrate forms an upward swirl flow due to the action of the swirl baffle. The hydrate swirl flow flows into the recovery mechanism and then leaves the first separation sleeve, so as to realize the separation of mud and sand and natural gas hydrate. After the mud and sand accumulated on the sand discharge mechanism reaches a certain weight, the first separator is discharged from the sand discharge mechanism, which reduces the conveying capacity of hydrate conveying pipe, which reduces the consumption of mud and sand transported by pump and improves the recovery efficiency of hydrate. Further, the second separator is arranged to further separate the mud, sand and water in the hydrate, so as to realize effectively separation of the solid particles of mud and sand with cross-scale and micron scale ultra-fine particle size in the multiphase mixed hydrate slurry, to ensure the purity of the hydrate returned in the development process. At the same time, due to the in-situ discharge of mud and sand, the porosity of hydrate reservoir and the instability of well wall after goaf area caused by large sand discharge during hydrate mining are avoided.

BRIEF DESCRIPTION OF THE DRAWINGS

The invention may best be understood by referring to the following description and accompanying drawings that are used to illustrate embodiments of the invention. The invention is illustrated by ways of example in the embodiments and it not limited in the figures of the accompanying drawings, in which like references indicates similar elements.

REFERENCE MARK

Figure 1:
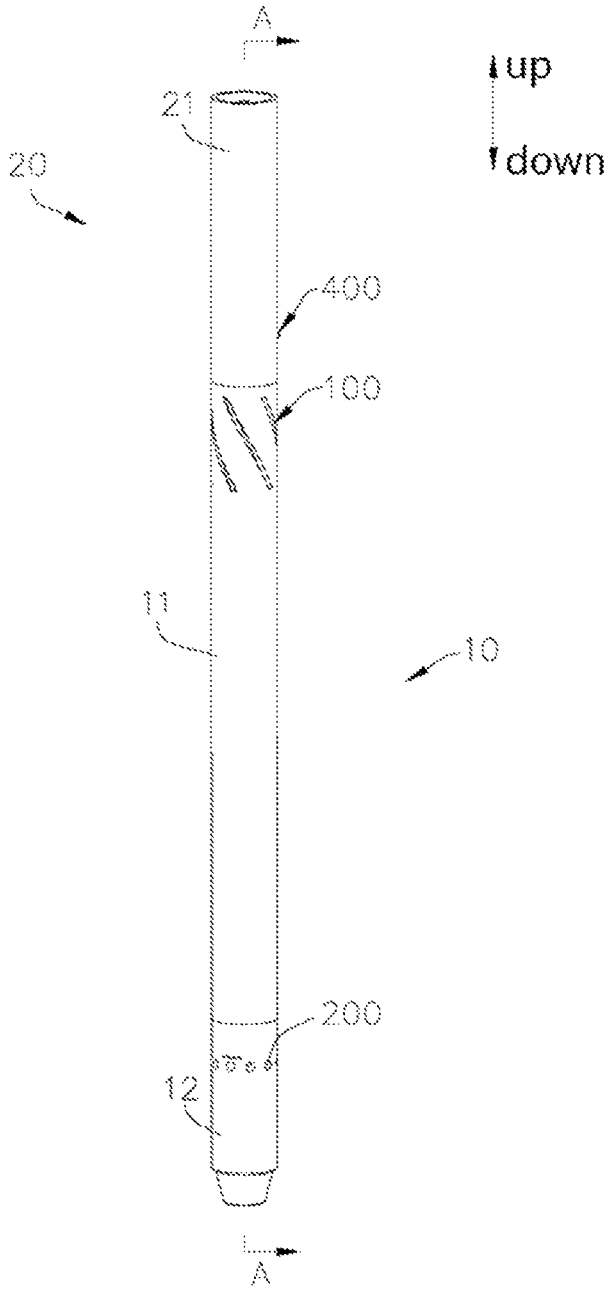
FIG. 1 is an overall schematic diagram of the embodiment of the present disclosure.
Figure 2:
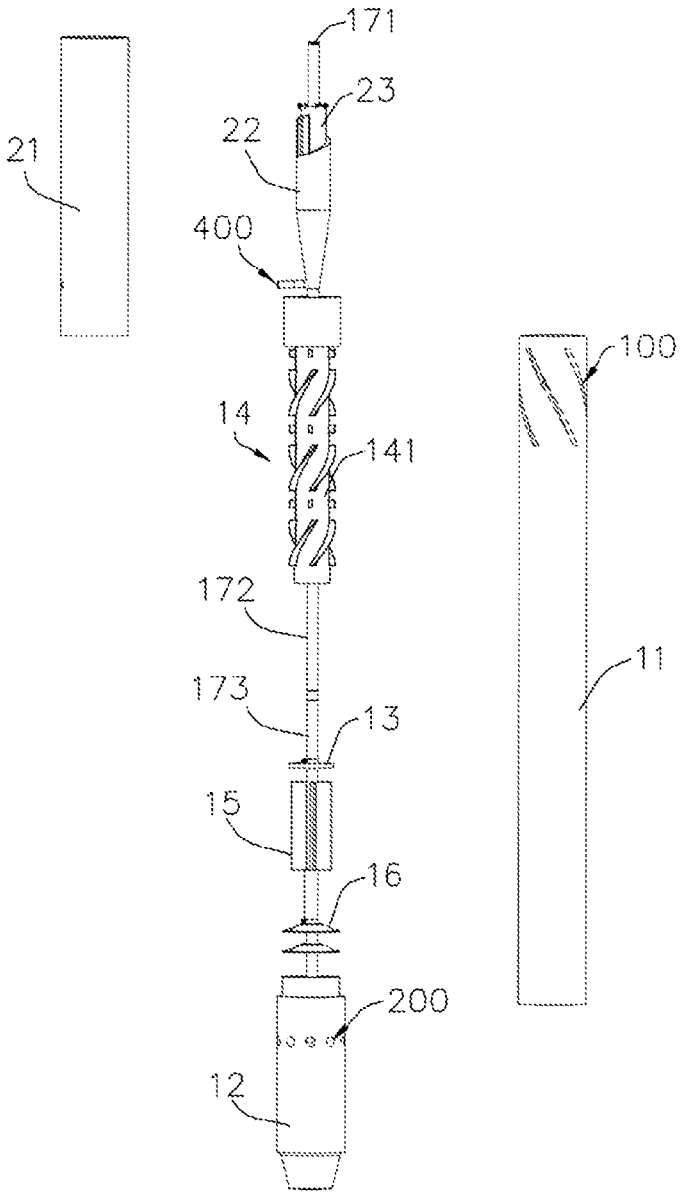
FIG. 2 is an explosion diagram of the embodiment of the present disclosure.

First separator 10, first separation sleeve 11, sand discharge mechanism 12, swirl baffle 13, recovery mechanism 14, crushing reamer 1411, rotation connector 151, connector 152; flow stabilization baffle 15, balance device 16, first power liquid pipe 171, second power liquid pipe 172, third power liquid pipe 173, first helical blade 1721, second helical blade 1722, second separator 20, second separation sleeve 21, first sleeve 22, second sleeve 23, first suction inlet 100, sliding barrel 121, sliding sleeve 122, spring 123, recovery sleeve 141, first sand discharge hole 200, second suction inlet 300, second sand discharge hole 400.

DETAILED DESCRIPTION OF THE PREFERRED EMBODIMENTS

In the description of the present invention, it should be understood that if orientation or position relations indicated by the terms such as "upper," "lower," "left," "right," "front," "back," and the like are based on the orientation or position relations shown in the drawings, and the terms are intended only to facilitate the description of the present invention and simplify the description, rather than indicating or implying that the apparatus or element referred to must have a particular orientation and be constructed and operated in the particular orientation, and therefore cannot be construed as a limitation on the present invention.

In the description of the disclosure, the meaning of "several" is more than one, and the meaning of "a plurality of" is more than two. "greater than", "less than", and "more than", etc. are understood as excluding this number, and the "above", "below", "within", etc. are understood as including this number. It is described that "first" and "second" are only for the purpose for distinguishing technical features, it cannot be understood as indicating or implying relative importance, or implicitly indicating the number of indicated technical features, or implicitly indicating the order of indicated technical features.

In the present invention, the terms "first," "second," and "third" are merely for the purpose of description, but cannot be understood as indicating or implying relative importance. The term "multiple" means two or more unless otherwise explicitly defined. The terms "mount," "connect with," "connect," "fix," and the like shall be understood in a broad sense. For example, "connect" may mean being fixedly connected, detachably connected, or integrally connected; and "connect with" may mean being directly connected or indirectly connected through an intermediary. For those of ordinary skill in the art, specific meanings of the above terms in the present invention can be understood according to specific situations.

Referring to FIG. 1 to FIG. 9, the solid fluidization tubular separator for marine natural gas hydrate according to the embodiment of the present disclosure includes a first separator 10, which includes a first separation sleeve 11, a power liquid pipe, a swirl baffle 13, a recovery mechanism 14 and a sand discharge mechanism 12.

Figure 3:
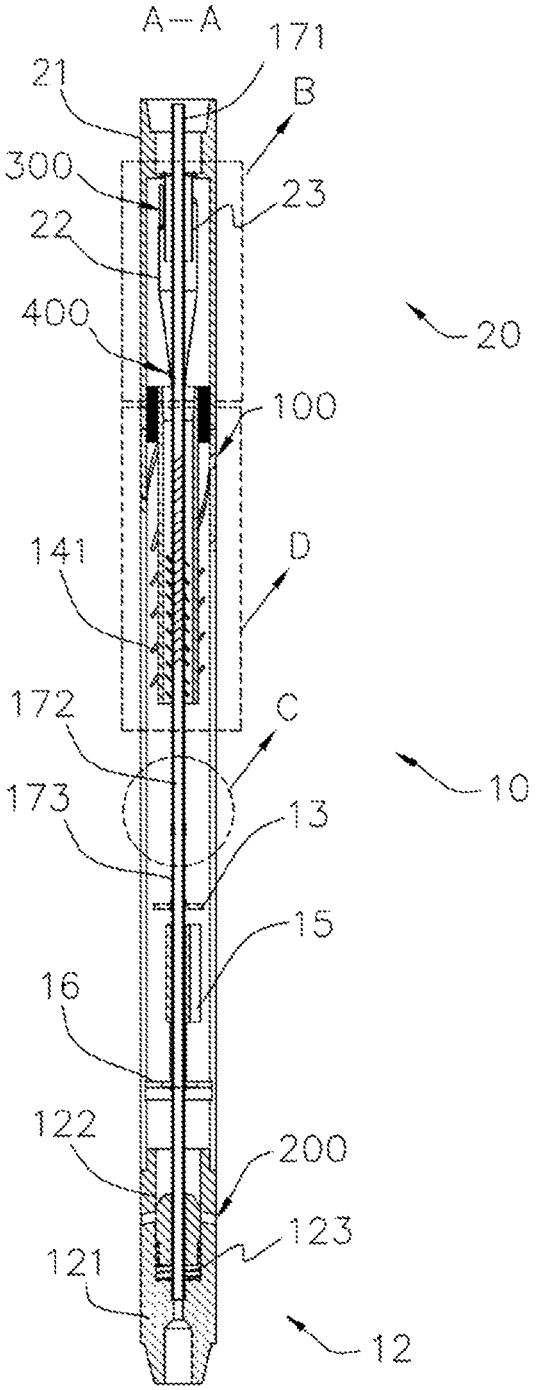
FIG. 3 is a schematic sectional view of A-A in FIG. 1.

Referring to FIG. 1 and FIG. 3, the first separation sleeve 11 is provided with a first suction inlet 100. The first suction inlet 100 is arranged at the middle and upper part of the first separation sleeve 11, and the first suction inlet 100 is helical. The power liquid pipe is arranged in the first separation sleeve 11, and the axis of the power liquid pipe coincides with the axis of the first separation sleeve 11. The swirl baffle 13 is arranged on the outer circumference of the power liquid pipe, and there is a gap between the swirl baffle 13 and the inner wall of the first separation sleeve 11. The recovery mechanism 14 is arranged between the power liquid pipe and the first separation sleeve 11, and the recovery mechanism 14 is arranged above the swirl baffle 13, and a sand discharge mechanism 12 connected to the lower end of the first separation sleeve 11.

The helical first suction inlet 100 on the first separation sleeve 11 causes the natural gas hydrate to be sucked into the first separation sleeve 11 to produce centrifugal effect. The mud and sand with high density are separated to the pipe wall surface of the first separation sleeve 11. The mud and sand separated to the pipe wall surface settle downward from the gap between the swirl baffle 13 and the pipe wall surface, and finally accumulate on the sand discharge mechanism 12. Because the density of the hydrate is small, then it converges in the middle of the first separation sleeve 11 and continues to flow downward to the swirl baffle 13. The hydrate forms an upward swirl due to the action of the swirl baffle 13. The hydrate flows into the recovery mechanism 14 and then leaves the first separation sleeve 11, so as to realize the separation of mud and sand and natural gas hydrate. After the mud and sand accumulated on the sand discharge mechanism 12 reaches a certain weight, the first separator 10 is discharged from the sand discharge mechanism 12, which reduces the conveying capacity of the hydrate conveying pipe (not shown in the figure), reduces the consumption of mud and sand transported by the pump, and improves the recovery efficiency of hydrate. At the same time, due to the in-situ discharge of mud and sand, the porosity of hydrate reservoir and the instability of well wall after forming goaf area caused by large sand discharge during hydrate mining are avoided.

The recovery mechanism 14 includes a recovery sleeve 141. The recovery sleeve 141 is sleeved on the power liquid pipe, the inner diameter of the recovery sleeve 141 is greater than the outer diameter of the power liquid pipe, the upper part of the recovery sleeve 141 is connected to the first separation sleeve 11, and the gap between the recovery sleeve 141 and the power liquid pipe forms a recovery channel of hydrate. Since the first suction inlet 100 is helical, the hydrate outside the first separator 10 enters the first suction inlet 100 and generates centrifugal action to preliminarily separated. The preliminarily separated hydrate forms an upward swirl flow under the action of the swirl baffle 13, and the hydrate forming a swirl flow flows upward along the power liquid pipe and flows into the recovery channel of the recovery sleeve 141, due to centrifugation and gravity, the mud and sand settle down along the pipe wall of the first separation sleeve 11, and then discharge out of the first separator 10 through the sand discharge mechanism 12, so as to achieve the purpose of separating the mud and sand in the hydrate.

The solid fluidization tubular separator for marine natural gas hydrate further includes a second separator 20. The second separator 20 is connected to the upper end of the first separation sleeve 11, and the hydrate enters the second separator 20 through the recovery mechanism 14. The hydrate separated by the first separator 10 then enters the second separator 20 to further separate the mud, sand and water in the hydrate, so as to realize the effective separation of the solid particles of mud and sand with cross-scale and micron scale ultra-fine particle size in the multiphase mixed hydrate slurry, to ensure the purity of the hydrate returned in the development process.

Referring to FIG. 2 to FIG. 6, in one possible embodiment, the power liquid pipe includes a first power liquid pipe 171, a second power liquid pipe 172 and a third power liquid pipe 173. Wherein, the first power liquid pipe 171 and the third power liquid pipe 173 are fixedly arranged inside the first separation sleeve 11, the upper and lower ends of the second power liquid pipe 172 are rotationally connected with the first power liquid pipe 171 and the third power liquid pipe 173 respectively, and a sealing device is arranged at the position where the second power liquid pipe 172 is rotationally connected with the first power liquid pipe 171 and the third power liquid pipe 173, so as to avoid the leakage of power liquid at the rotational connection.

Figure 6:
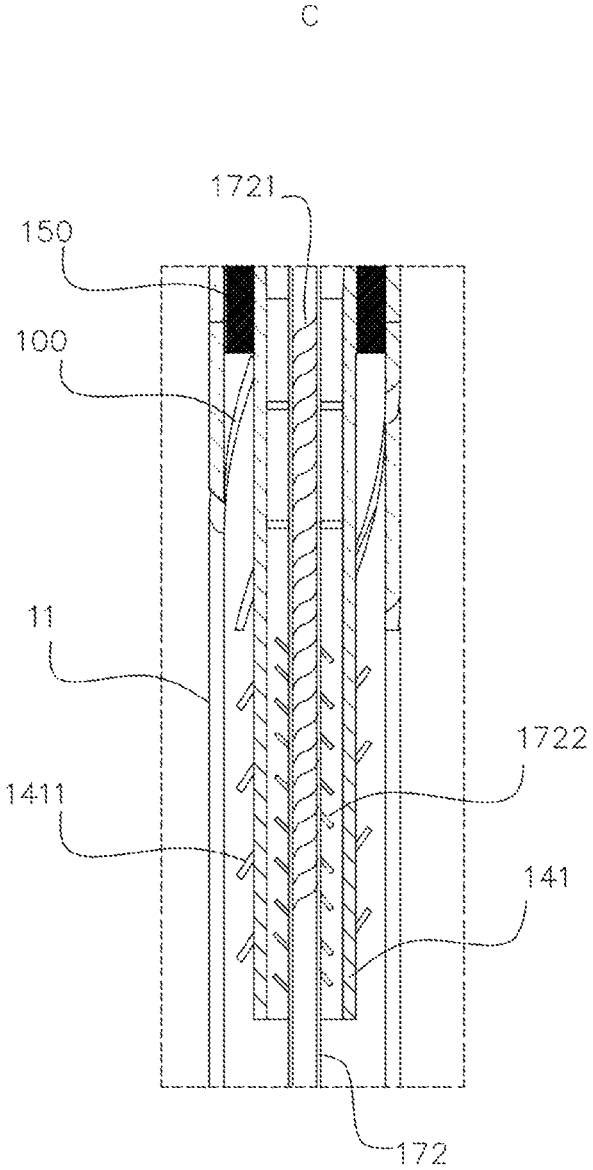
FIG. 6 is a partially enlarged view of Part D in FIG. 3.

The recovery sleeve 141 is integrally arranged with the second power liquid pipe 172. Referring to FIG. 6, specifically, a connector 152 is arranged between the outer wall of the second power liquid pipe 172 and the inner wall of the recovery sleeve 141, and the recovery sleeve 141 is rotationally connected to the first separation sleeve 11. Further, a first helical blade 1721 is fixedly arranged inside the second power liquid pipe 172, and a crushing reamer 1411 is arranged on the outer pipe wall of the recovery sleeve 141. The power liquid drives the first helical blade 1721 to drive the second power liquid pipe 172 to rotate, and then drives the recovery sleeve 141 to rotate. Referring to FIG. 6, a rotation connector 151, which may be a bearing, is arranged above the first suction inlet 100 on the first separation sleeve 11, and the upper end of the recovery sleeve 141 is rotationally connected to the rotation connector 151. Such an arrangement can improve the stability when the second power liquid pipe 172 rotates with the recovery sleeve 141.

Figure 7:
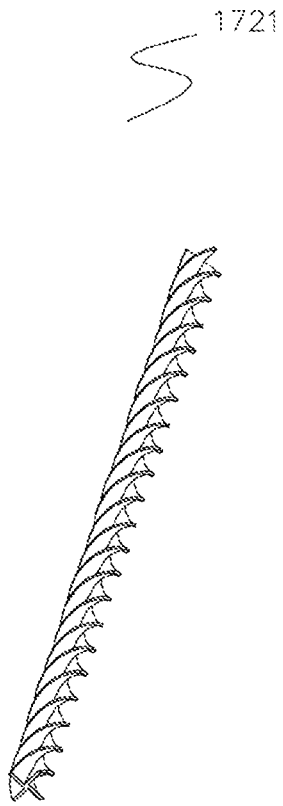
FIG. 7 is a structural diagram of the first helical blade in the embodiment of the present disclosure.
Figure 8:
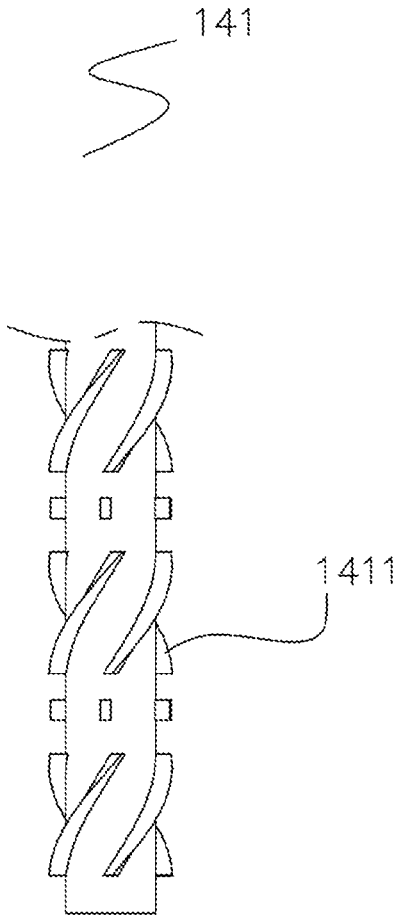
FIG. 8 is a structural diagram of the recovery sleeve in the embodiment of the present disclosure.

Referring to FIG. 6 and FIG. 7, the first helical blade 1721 is fixedly arranged inside the second power liquid pipe 172. When the power liquid flows through the second power liquid pipe 172, the power liquid drives the first helical blade 1721 to drive the second power liquid pipe 172 to rotate. Since a crushing reamer 1411 is arranged on the outer pipe wall of the recovery sleeve 141, when the natural gas hydrate is sucked into the first separation sleeve 11, since the recovery sleeve 141 rotates together with the second power liquid pipe 172. Further, referring to FIG. 8, a crushing reamer 1411 is arranged on the recovery sleeve 141, and the natural gas hydrate passes through the crushing action of the crushing reamer 1411, and the large mud and sand is crushed into fine particles. Meanwhile, the centrifugal effect of the swirl field generated by the rotation of the recovery sleeve 141 can also break the cementation of the natural gas hydrate, so as to realize the separation of cross-scale micron particles of the natural gas hydrate mixed slurry, so as to improve the cleanliness of the hydrate slurry and improve the production capacity.

Figure 9:
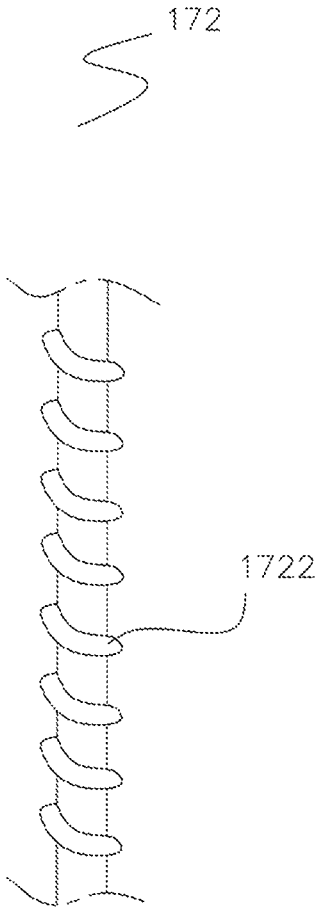
FIG. 9 is a structural diagram of the second power liquid pipe in the embodiment of the present disclosure.

Referring to FIG. 7 and FIG. 9, in one possible embodiment, the outer wall of the second power liquid pipe 172 is provided with a second helical blade 1722, and the rotation direction of the second helical blade 1722 is opposite to that of the first helical blade 1721. The second helical blade 1722 can be made of hard material and connected with the recovery sleeve 141 and the second power liquid pipe 172. In this arrangement, the second helical blade 1722 acts as a connector. Alternatively, the second helical blade 1722 may be made of a flexible material and fixedly connected with the second power liquid pipe 172. Since the rotation direction of the second helical blade 1722 is opposite to that of the first helical blade 1721, when the second power liquid pipe 172 rotates, an upward suction force is formed in the recovery channel, so that the hydrate can be sucked into the recovery channel, so as to enter the second separator 20 more smoothly.

In one possible embodiment, the swirl baffle 13 is arranged outside the third power liquid pipe 173, and the lower end of the recovery sleeve 141 is located between the first suction inlet 100 and the swirl baffle 13. The first suction inlet 100 is higher than the lower end of the recovery sleeve 141, which avoids the impact of the hydrate flowing into the first separation sleeve 11 from the first suction inlet 100 on the upward flowing hydrate swirl modeling, and then improves the separation efficiency of the preliminary separation of hydrate.

In an alternative embodiment, the sand discharge mechanism 12 includes a sliding sleeve 122 and a spring 123, the sliding sleeve 122 is sleeved on the third power liquid pipe 173, the spring 123 is fixedly connected to the lower end of the sliding sleeve 122, the sand discharge mechanism 12 also has a first sand discharge hole 200, and the sliding sleeve 122 is moved downward by the compression of the spring 123, so as to communicate the first sand discharge hole 200 with the first separation sleeve 11. The sand discharge mechanism also includes a sliding barrel 121. The sliding barrel 121 is slidably connected with the sliding sleeve 122. The other end of the spring is connected to the sliding barrel 121. The first sand discharge hole 200 are arranged on the sliding barrel 121. The mud and sand settled downward from the pipe wall of the first separation sleeve 11 is accumulated above the sand discharge mechanism 12. When the mud and sand accumulate to a certain weight, the spring 123 is squeezed by the sliding sleeve 122 until the upper surface of the sliding sleeve 122 is lower than the first sand discharge hole 200. At this moment, the inner cavity of the first separation sleeve 11 is communicated with the outside. The mud and sand accumulated on the sand discharge mechanism 12 is discharged from the solid fluidization tubular separator for marine natural gas hydrate through the first sand discharge hole 200.

In one possible embodiment, the first separator 10 also includes a flow stabilization baffle 15. The flow stabilization baffle 15 is arranged between the swirl baffle 13 and the sand discharge mechanism 12, that is, the flow stabilization baffle 15 is arranged outside the third power liquid pipe 173. A flow stabilization baffle 15 is arranged below the swirl baffle 13, and the flow stabilization baffle 15 is used to inhibit and block the circumferential movement of the mud and sand flowing downward from the first suction inlet 100, so as to avoid the mud and sand accumulated on the sand discharge mechanism 12 from flowing upward again due to excessive impact, and avoid the sliding sleeve 122 from being directly washed away, resulting in the failure of the action of the spring 123 and the sliding sleeve 122.

In one possible embodiment, the solid fluidization tubular separator for marine natural gas hydrate also includes a balance device 16. The balance device 16 includes a balance valve which is arranged between the flow stabilization baffle 15 and the sand discharge mechanism 12, that is, located on the third power liquid pipe 173. When the pressure on the side of the balance valve close to the first suction inlet 100 reaches the preset pressure value, the balance valve opens so that the mud and sand can flow to the sand discharge mechanism 12. The balance valve is provided to avoid the downward flow of mud and sand from directly impacting on the mud and sand accumulated on the sand discharge mechanism, ensuring the separation purity and efficiency of hydrate.

In one possible embodiment, the balance device 16 also includes a one-way valve which allows the mud and sand in the first separation sleeve 11 flow only from the first suction inlet 100 to the first sand discharge hole 200, avoiding the reverse flow of mud and sand caused by excessive external pressure of the solid fluidization tubular separator for marine natural gas hydrate.

In a possible embodiment, the second separator 20 includes a first sleeve 22, a second sleeve 23 and a second separation sleeve 21. The first sleeve 22 is sleeved on the first power liquid pipe 171, the second sleeve 23 is arranged between the first power liquid pipe 171 and the first sleeve 22, and the upper end of the second sleeve 23 is fixedly connected to the second separation sleeve 21, the lower end of the second separation sleeve 21 is butted with the upper end of the first separation sleeve 11, the upper part of the first sleeve 22 is provided with a second suction inlet 300, the second separator 20 is also provided with a second sand discharge hole 400, and the second sand discharge hole 400 is arranged at the lower end of the first sleeve 22.

Wherein, the lower end of the first sleeve 22 is fixedly connected with the first power liquid pipe 171, and the outer diameter of the first sleeve 22 is less than the inner diameter of the first separation sleeve 11, that is, there is a chamber between the first sleeve 22 and the first separation sleeve 11. There is an annular chamber between the second sleeve 23 and the first power liquid pipe 171, and the annular chamber serves as a flow channel for the hydrate to flow out of the second separator 20. A sand discharge pipe is connected at the second sand discharge hole 400. The sand discharge pipe is configured to communicate the interior of the first sleeve 22 with the exterior of the second separator 20. It can be understood that the annular chamber communicates the upper end of the second separation sleeve 21 with the chamber surrounded by the first sleeve 22, the second sleeve 23 and the first power liquid pipe 171.

The natural gas hydrate flows into the second separator 20 from the recovery mechanism 14 and enters the first sleeve 22 through the second suction inlet 300. After the hydrate flows through the annular chamber between the first sleeve 22 and the second sleeve 23, under the action of the flow field, the hydrate flows out of the second separation sleeve 21 from the lower end of the second sleeve 23, the mud and sand settle downward under the action of gravity and are discharged out of the second separator 20 through the second sand discharge hole 400.

Figure 4:
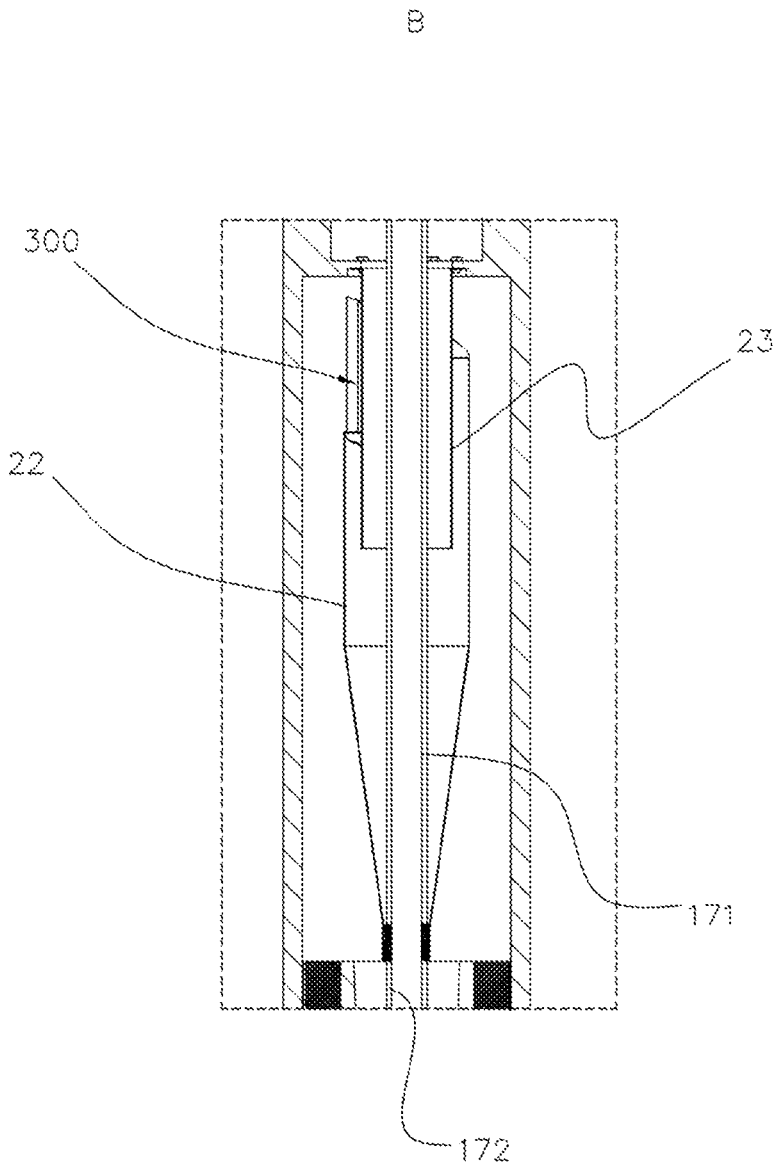
FIG. 4 is a partially enlarged view of Part B in FIG. 3.
Figure 5:
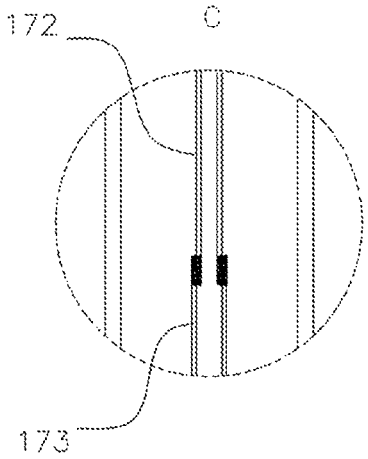
FIG. 5 is a partially enlarged view of Part C in FIG. 3.

In one possible embodiment, the second suction inlet 300 is arranged on the side of the helical sleeve to improve the efficiency of hydrate entering the interior of the first sleeve 22, as shown in FIG. 4.

In one possible embodiment, the upper end of the first sleeve 22 is a helical sleeve, and the second suction inlet 300 is arranged on the helical sleeve. Further, the lower end of the first sleeve 22 is conical. The helical sleeve makes the hydrate entering the first sleeve 22 form a swirling flow. The swirling flow first flows downward along the inner wall of the first sleeve 22. When the swirling flow reaches the connecting part between the first sleeve 22 and the first power liquid pipe 171. The swirling flow changes the flow direction, that is, after the swirling flow reaches the bottom of the first sleeve 22, it flows upward along the first power liquid pipe 171 and flows out of the second separator 20 through the second sleeve 23. Due to the high density, the mud and sand are retained at the bottom of the first sleeve 22 and finally discharged out of the second separator 20 through the second sand discharge hole 400. The lower part of the first sleeve 22 is conical to prevent the lower end of the first sleeve 22 from blocking or decelerating the flow of natural gas hydrate entering the second separator 20, so as to deposit the mud and sand in the natural gas hydrate and block the recovery channel of the recovery mechanism 14.

It can be understood that the solid fluidization tubular separator for marine natural gas hydrate of the embodiment of the disclosure also includes a connection interface for external connection, which can connect the solid fluidization tubular separator for marine natural gas hydrate of the embodiment of the disclosure to the hydrate mining equipment.

What is claimed is:

1. A solid fluidization tubular separator for marine natural gas hydrate, comprising a first separator, wherein the first separator comprises a first separation sleeve, a power liquid pipe, a swirl baffle, a recovery mechanism and a sand discharge mechanism;

the first separation sleeve is provided with a first suction inlet, the first suction inlet is arranged at a middle and upper part of the first separation sleeve, and the first suction inlet is a helical shape;

the power liquid pipe is arranged in the first separation sleeve, and an axis of the power liquid pipe coincides with an axis of the first separation sleeve;

the swirl baffle is arranged on an outer circumference of the power liquid pipe, and there is a gap between the swirl baffle and an inner wall of the first separation sleeve;

the recovery mechanism is arranged above the swirl baffle, the recovery mechanism comprises a recovery sleeve, the recovery sleeve is arranged on the power liquid pipe; a inner diameter of the recovery sleeve is greater than an outer diameter of the power liquid pipe, and an upper part of the recovery sleeve is connected with the first separation sleeve;

the gap between the recovery sleeve and the power liquid pipe forms a hydrate recovery channel;

the sand discharge mechanism is connected to a lower end of the first separation sleeve:

a second separator is further provided, wherein the second separator is connected to an upper end of the first separation sleeve, and the hydrate enters the second separator through the recovery mechanism.

2. The solid fluidization tubular separator for marine natural gas hydrate according to claim 1, wherein the power liquid pipe comprises a first power liquid pipe, a second power liquid pipe and a third power liquid pipe, the first power liquid pipe and the third power liquid pipe are fixedly arranged, and the second power liquid pipe is rotationally connected with the first power liquid pipe and the third power liquid pipe respectively; the recovery sleeve is integrally arranged with the second power liquid pipe, the recovery sleeve is rotationally connected to the first separation sleeve, an interior of the second power liquid pipe is fixedly provided with a first helical blade, an outer pipe wall of the recovery sleeve is provided with a crushing reamer, and the first helical blade is driven by dynamic liquid to drive the second power liquid pipe to rotate, so as to drive the recovery sleeve to rotate.

3. The solid fluidization tubular separator for marine natural gas hydrate according to claim 2, wherein an outer wall of the second power liquid pipe is provided with a second helical blade, and a rotation direction of the second helical blade is opposite to the first helical blade.

4. The solid fluidization tubular separator for marine natural gas hydrate according to claim 1, wherein a lower end of the recovery sleeve is located between the first suction inlet and the swirl baffle.

5. The solid fluidization tubular separator for marine natural gas hydrate according to claim 1, wherein the sand discharge mechanism comprises a sliding sleeve and a spring, the sliding sleeve is sleeved on the power liquid pipe, the spring is fixedly connected to the lower end of the sliding sleeve; the sand discharge mechanism is provided with a first sand discharge hole, and the sliding sleeve is moved downward by compressing the spring to communicate the first sand discharge hole with the first separation sleeve.

6. The solid fluidization tubular separator for marine natural gas hydrate according to claim 5, wherein the first separator further comprises a flow stabilization baffle, and the flow stabilization baffle is arranged between the swirl baffle and the sand discharge mechanism.

7. The solid fluidization tubular separator for marine natural gas hydrate according to claim 6, wherein the first separator further comprises a balance device, the balance device comprises a balance valve, and the balance valve is arranged between the flow stabilization baffle and the sand discharge mechanism.

8. The solid fluidization tubular separator for marine natural gas hydrate according to claim 1, wherein the second separator comprises a first sleeve, a second sleeve and a second separation sleeve, the first sleeve is sleeved on the power liquid pipe, and the second sleeve is arranged between the power liquid pipe and the first sleeve; an upper end of the second sleeve is fixedly connected to the second separation sleeve, an lower end of the second separation sleeve is butted with the upper end of the first separation sleeve, an upper part of the first sleeve is provided with a second suction inlet, the second separator is provided with a second sand discharge hole, and the second sand discharge hole is arranged on the first sleeve.

9. The solid fluidization tubular separator for marine natural gas hydrate according to claim 8, wherein the upper end of the first sleeve is a helical sleeve, and the second suction inlet is arranged on the helical sleeve.

10. The solid fluidization tubular separator for marine natural gas hydrate according to claim 8, wherein a lower part of the first sleeve is conical.

* * * * *